US009314901B2

(12) United States Patent
Lee et al.

(10) Patent No.: US 9,314,901 B2
(45) Date of Patent: Apr. 19, 2016

(54) CMP PAD CONDITIONER, AND METHOD FOR PRODUCING THE CMP PAD CONDITIONER

(75) Inventors: Seh Kwang Lee, Yongin-si (KR); Youn Chul Kim, Hwaseong-si (KR); Joo Han Lee, Seongnam-si (KR); Jae Kwang Choi, Suwon-si (KR); Jae Phil Boo, Seongnam-si (KR)

(73) Assignee: EHWA DIAMOND INDUSTRIAL CO., LTD., Osan-Si (KR)

( * ) Notice: Subject to any disclaimer, the term of this patent is extended or adjusted under 35 U.S.C. 154(b) by 82 days.

(21) Appl. No.: 14/117,936

(22) PCT Filed: May 15, 2012

(86) PCT No.: PCT/KR2012/003788

§ 371 (c)(1),
(2), (4) Date: Dec. 16, 2013

(87) PCT Pub. No.: WO2012/157936

PCT Pub. Date: Nov. 22, 2012

(65) Prior Publication Data

US 2014/0094101 A1 Apr. 3, 2014

(30) Foreign Application Priority Data

May 17, 2011 (KR) ..... 10-2011-0046305

(51) Int. Cl.

*B24B 53/017* (2012.01)
*B24B 53/02* (2012.01)
*B24D 18/00* (2006.01)

(52) U.S. Cl.

CPC ..... *B24B 53/017* (2013.01); *B24D 18/00* (2013.01)

(58) Field of Classification Search

CPC ..... B24B 53/017; B24B 53/02; B24B 53/12; B24D 18/00

USPC ..... 451/56, 443

See application file for complete search history.

(56) References Cited

U.S. PATENT DOCUMENTS

| | | | | |
|---|---|---|---|---|
| 5,486,131 | A * | 1/1996 | Cesna et al. | 451/56 |
| 6,439,986 | B1 * | 8/2002 | Myoung et al. | 451/443 |
| 6,500,054 | B1 * | 12/2002 | Ma et al. | 451/56 |
| 7,258,708 | B2 * | 8/2007 | Sung | 51/307 |

(Continued)

FOREIGN PATENT DOCUMENTS

| | | |
|---|---|---|
| CN | 1391506 A | 1/2003 |
| CN | 1774316 A | 5/2005 |

(Continued)

OTHER PUBLICATIONS

Taiwanese Office Action dated Jul. 22, 2014, issued to the corresponding Taiwanese Application No. 101117365.

(Continued)

*Primary Examiner* — Eileen Morgan
(74) *Attorney, Agent, or Firm* — Stein IP, LLC

(57) ABSTRACT

This invention relates to a conditioner for a CMP (Chemical Mechanical Polishing) pad, which is used in a CMP process which is part of the fabrication of a semiconductor device, and more particularly, to a CMP pad conditioner in which the structure of the cutting tips is such that the change in the wear of the polishing pad is not great even when different kinds of slurry are used and when there are changes in pressure of the conditioner, and to a method of manufacturing the same.

15 Claims, 4 Drawing Sheets

(56) References Cited

U.S. PATENT DOCUMENTS

| | | | | |
|---|---|---|---|---|
| 2006/0079162 | A1* | 4/2006 | Yamashita et al. | 451/444 |
| 2009/0221216 | A1* | 9/2009 | Fujita | 451/56 |
| 2010/0273402 | A1* | 10/2010 | Shimizu | 451/56 |
| 2014/0113532 | A1* | 4/2014 | Smith et al. | 451/443 |
| 2014/0120724 | A1* | 5/2014 | Sung | 438/692 |

FOREIGN PATENT DOCUMENTS

| | | | |
|---|---|---|---|
| JP | 2006-518940 | A | 8/2006 |
| JP | 2008-244337 | A | 10/2008 |
| JP | 2010-69612 | A | 4/2010 |
| JP | 2010-125587 | A | 6/2010 |
| JP | 2010-536183 | A | 11/2010 |
| JP | 2011-20182 | A | 2/2011 |
| KR | 10-2000-0024453 | A | 5/2000 |
| KR | 10-2008-0061716 | A | 7/2008 |
| KR | 10-0847121 | B1 | 7/2008 |
| TW | 467802 | | 12/2001 |
| TW | 200510116 | A | 3/2005 |

OTHER PUBLICATIONS

Japanese Office Action dated Jul. 29, 2014, issued to the corresponding Japanese Application No. 2014-511292.

S.K. Kang et al., "The properties of pad conditioning according to manufacturing methods of CMP pad conditioner", Korea Society for Precision Engineering, Journal of 2005 Fall Conference, pp. 362-365, 2005.

Korean Office Action dated Dec. 9, 2011, issued in corresponding Korean Application No. 10-2011-0046305.

International Search Report mailed Jan. 2, 2013, issued in corresponding International Application No. PCT/KR2012/003788.

Taiwanese Office Action dated Jun. 5, 2015, issued to Taiwanese Application No. 101117365.

Chinese Office Action dated Jul. 1, 2015, issued to Chinese Application No. 201280023632.9.

* cited by examiner

CMP PAD CONDITIONER, AND METHOD FOR PRODUCING THE CMP PAD CONDITIONER

CROSS-REFERENCE TO RELATED APPLICATIONS

This application is a national stage of International Application No. PCT/KR2012/003788, filed May 15, 2012, which claims the benefit of Korean Application No. 10-2011-0046305, filed May 17, 2011, in the Korean Intellectual Property Office. All disclosures of the document(s) named above are incorporated herein by reference.

BACKGROUND OF THE INVENTION

1. Field of the Invention

The present invention relates to a conditioner for a CMP (Chemical Mechanical Polishing) pad, which is used in a CMP process which is part of the fabrication of a semiconductor device, and more particularly, to a CMP pad conditioner in which the structure of the cutting tips is such that the change in the wear of the polishing pad is not great even when different kinds of slurry are used and when there are changes in pressure of the conditioner, and to a method of manufacturing the same.

2. Description of the Related Art

CMP techniques which are useful in semiconductor apparatuses are used to planarize a thin film such as an insulating layer or a metal layer formed on a semiconductor wafer.

A planarization process using CMP is carried out in such a way that a polishing pad is attached onto a platen which rotates and a wafer which is to be polished is held by means of a carrier, and while a slurry is supplied onto the pad, the platen and the carrier are subjected to motion relative to each other in a state of applying pressure to the carrier that holds the wafer, thus polishing the wafer.

In the CMP process for planarization, the uniformity of the removal rate (i.e. polishing uniformity) across the surface of a workpiece such as a wafer is regarded as important. Among a variety of factors for increasing the polishing uniformity, the surface state of the polishing pad may be included as an important quantitative factor.

The preferred surface state of the polishing pad may be achieved by conditioning the polishing pad, including cutting the surface of the deformed pad using a conditioner, in order to restore the worn or clogged pores of the polishing pad and the decreased flatness of the polishing pad to its original state.

As such, the conditioning process enables the surface state of the polishing pad to be optimized to an initial state which has a high ability to retain the slurry, using a pad conditioner having a grinder such as diamond which is put in contact with the polishing pad to scrape or rub the surface of the polishing pad. Alternatively, this process may function to restore the ability of the polishing pad to retain the slurry so that the polishing capability of the polishing pad can be maintained.

Meanwhile, examples of a slurry used in the CMP process may include an oxide slurry, a tungsten (W) slurry, and a copper (Cu) slurry. These slurries may differently affect the pad in the CMP process because they are different in terms of the kind, shape and size of polishing particles and the kind and amount of additives. Also, the case where the material of the pad and the pressure which is applied to the CMP pad conditioner put in contact with the pad are varied may result in having different effects on the pad used in the CMP process.

Thus even when the same CMP pad conditioner is used, the wear of the pad may vary depending on the kind of slurry, the material of the pad and changes in pressure. Upon conditioning, because the conditioner used should be adapted for a slurry, a pad and changes in pressure, numerous products having a variety of specifications should be evaluated to deduce the appropriate CMP pad conditioner, which is considered troublesome.

Particularly among conventional CMP pad conditioners, a diamond electroplating type pad conditioner has the following problems. Specifically, diamond particles for polishing may have a variety of shapes, including a cube shape, an octahedral shape, a cube-octahedral shape, etc. upon preparation, and even when diamond having a predetermined shape is used, it is attached regardless of orientation, making it difficult to control the height of diamond which protrudes, and thereby the area of diamond which is put in contact with the pad cannot be equivalently controlled and thus it is difficult to calculate the area of the diamond put in contact with the pad. This means that the pressure which is applied to respective diamond particles which are put in contact with the pad in the conditioner cannot be predicted, thus making it difficult to predict conditioning performance.

Also Korean Patent No. 10-0387954 discloses a CVD pad conditioner, which comprises a substrate having a plurality of truncated polypyramids protruding upwards at a uniform height from the surface thereof and a diamond layer deposited thereon using CVD. The CVD pad conditioner thus formed may be used under predetermined pressure, but for all that the conditioning of the polishing pad is not performed well in a state of PWR (Pad Wear Rate) being unstable, the extent of increase or decrease in PWR is undesirably very large depending on changes in pressure upon conditioning. Accordingly the conventional CVD conditioner disclosed in the above patent is problematic because the extent of change in PWR becomes large in proportion to changes in the load applied to the disk, and the pressure range of the disk which may be adapted for the kind of slurry is also very large.

SUMMARY OF THE INVENTION

Additional aspects and/or advantages of the invention will be set forth in part in the description which follows and, in part, will be obvious from the description, or may be learned by practice of the invention.

Technical Problem

Thus an object of the present invention is to provide a CMP pad conditioner having an optimal structure which enables stable use under any work conditions provided for conditioning, so that the extent to which PWR changes as a result of one or more selected from among the kind of slurry, the material of a pad and changes in pressure is small.

Another object of the present invention is to provide a method of manufacturing a CMP pad conditioner, wherein the CMP pad conditioner may be designed to have a structure which enables PWR to be estimated by conducting only a few tests in lieu of hundreds of tests, thus efficiently producing a CMP pad conditioner, thereby achieving superior productivity and product quality.

Still another object of the present invention is to provide a CMP pad conditioner which is configured such that the life thereof is longer and a period of time for which pad roughness is maintained constant is prolonged compared to a conventional CMP pad conditioner, and a method of manufacturing the same.

Yet another object of the present invention is to provide a CMP pad conditioner wherein the size and the number of cutting tips are determined so that PWR is maintained constant in a range of predetermined pressure being applied to the cutting tips, thus controlling the rate of wear of the cutting tips to thereby maximize and adjust a service life of the conditioner, and a method of manufacturing the same.

The objects of the present invention are not limited to the above, and the other objects which are not mentioned will be apparently understood by those skilled in the art from the following description.

Technical Solution

In order to accomplish the above objects, the present invention provides a CMP pad conditioner, comprising a substrate; and a plurality of cutting tips protruding upwards from a surface of the substrate and spaced apart from each other, wherein the cutting tips have a structure in which a top surface thereof is a plane parallel to the surface of the substrate, and an average pressure applied to each of the cutting tips upon conditioning ranges from 0.001 lbf/cu$^2$/ea to 0.2 lbf/cu$^2$/ea.

In a preferred embodiment, the upper portion of the cutting tips is formed so that an outer surface defined by connecting an outer circumference of the top surface of the cutting tips to an outer circumference of a cross-section of the cutting tips at a position 5~50 μm below the top surface of the cutting tips is at an angle of 87~93° with respect to the top surface of the cutting tips.

In a preferred embodiment, the cutting tips comprise protrusions and a cutting part extending from the protrusions and formed integratedly with or separately from the protrusions, wherein when the protrusions and the cutting part are formed separately from each other, the cutting part formed on an upper surface of the protrusions comprises a diamond layer formed by depositing diamond onto the upper surface of the protrusions using CVD.

In a preferred embodiment, a difference between an area of the top surface of the cutting tips before use of the CMP pad conditioner and an area of the top surface of the cutting tips after a service life of the CMP pad conditioner is within 10% over the life of the CMP pad conditioner.

In a preferred embodiment, the area of the top surface of each of the cutting tips is 25~10000 μm$^2$.

In a preferred embodiment, pad roughness is maintained in a range of 2~10 μm during conditioning.

In addition, the present invention provides a method of manufacturing the CMP pad conditioner as above, comprising determining an average pressure applied to each of cutting tips put in contact with a pad during conditioning to be in a range from 0.001 lbf/cu$^2$/ea to 0.2 lbf/cu$^2$/ea; determining a size and a number of a plurality of cutting tips which are to be formed to protrude upwards from a surface of a substrate, depending on the average pressure which was determined; and forming the cutting tips on the substrate, depending on the size and the number of the cutting tips, which were determined.

In a preferred embodiment, the size and the number of the plurality of cutting tips which are to be formed to protrude upwards from the surface of the substrate are determined by Equation 1 below.

$$Pe=(D/As)\div T \quad \text{[Equation 1]}$$

Pe: the average pressure applied to each of the cutting tips

D: a load

As: sum of areas of a top surface of all the cutting tips

T: the number of cutting tips

In a preferred embodiment, forming the cutting tips on the substrate comprises integratedly or separately forming the substrate and protrusions having any one shape selected from among a cylindrical shape, a polyprism shape, a truncated cone shape, and a truncated pyramid shape; and depositing diamond on a surface of the substrate and the protrusions using CVD thus forming a cutting part comprising a diamond layer.

In a preferred embodiment, in the cutting tips formation of which has been completed, the upper portion of the cutting tips is formed so that an outer surface defined by connecting an outer circumference of a top surface of the cutting tips to an outer circumference of a cross-section of the cutting tips at a position 5~50 μm below the top surface of the cutting tips is at an angle of 87~93° with respect to the top surface of the cutting tips.

In a preferred embodiment, the area of the top surface of the cutting tips is 25~10000 μm$^2$.

In a preferred embodiment, the cutting tips are formed in a columnar shape including a cylindrical shape or a polyprism shape, and a surface of the cutting tips comprises a diamond thin-film coating layer.

In a preferred embodiment, when the area of the top surface of the cutting tips is 25~625 μm$^2$, 2680~190000 cutting tips are formed, and when the area thereof is 625~2500 μm$^2$, 1340~38000 cutting tips are formed, and when the area thereof is 2500~10000 μm$^2$, 670~19000 cutting tips are formed.

In a preferred embodiment, a critical pressure range which is applied to the cutting tips is adjusted depending on the area of the top surface of the cutting tips, so that the pressure applied to each of the cutting tips is controlled without changing PWR, thus adjusting a service life of the CMP pad conditioner.

Advantageous Effects

The present invention can exhibit superior effects as follows.

Specifically in a CMP pad conditioner according to the present invention, an optimal structure, which can be stably used under any work conditions provided for conditioning, can be provided, and thus the extent to which PWR changes as a result of one or more selected from among the kind of slurry, the material of a pad and changes in pressures is small.

Also in a method of manufacturing a CMP pad conditioner according to the present invention, a CMP pad conditioner can be designed to have a structure which enables PWR to be estimated by conducting only a few tests in lieu of hundreds of tests, thus efficiently producing a CMP pad conditioner, thereby achieving superior productivity and product quality.

Also in a CMP pad conditioner and a method of manufacturing the same according to the present invention, the life of a product can be longer and a period of time for which pad roughness is maintained constant can be prolonged, compared to a conventional CMP pad conditioner.

Also according to the present invention, the surface roughness of a pad and the debris size required for the area of the cutting tips can change while the degree of polishing a pad is maintained constant.

Furthermore, the average pressure which is applied to the tips in need of uniformly maintaining PWR per slurry can be calculated. As the area of the tips is set, it is possible to design the number of tips required thereby.

Moreover, in the case where the average pressure applied to the cutting tips falls in the range of 0.001~0.2 lbf/cu$^2$/ea, the pressure applied to the cutting tips can be adjusted without changing PWR, thereby changing the rate of wear of the cutting tips, so that a service life of the conditioner can be lengthened when PWR is maintained constant.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
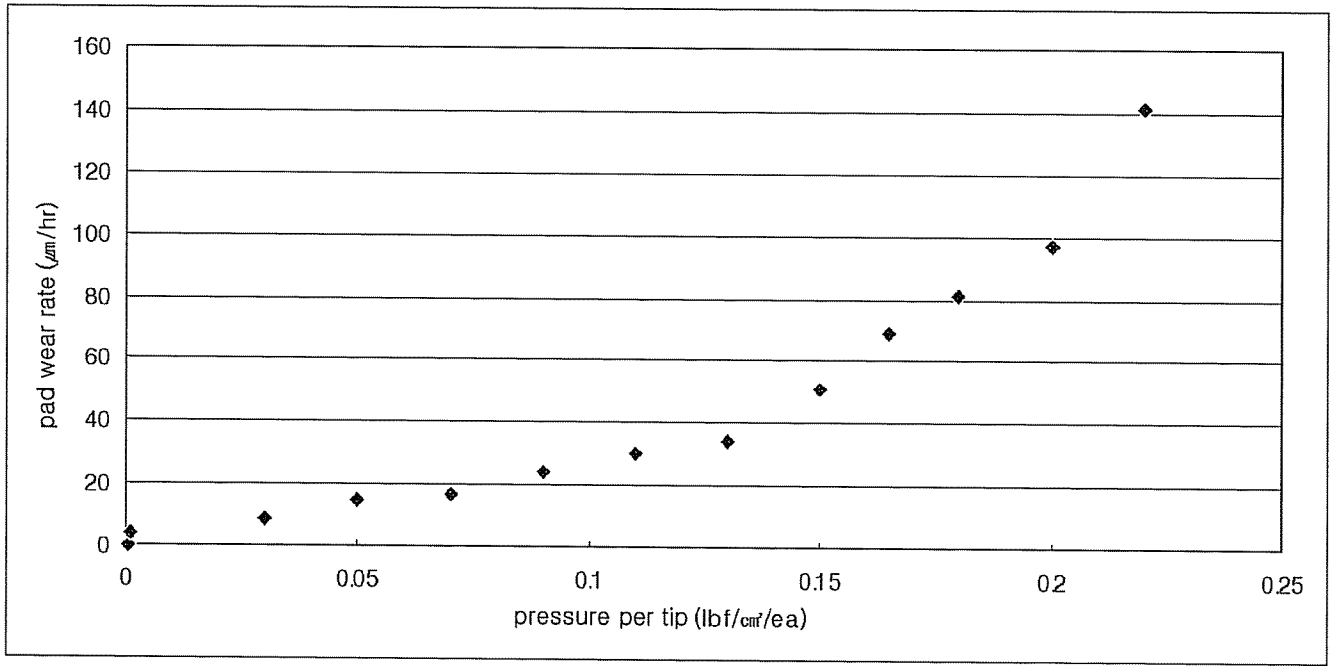
FIGS. 1 to 3 are graphs showing the results of measuring PWR of CMP pad conditioners 1 to 11 of Examples 1 to 11 according to the present invention and of comparative CMP pad conditioners 1 and 2 of Comparative Examples 1 and 2, depending on the kind of slurry.

The terms used in the present invention are as much as possible general terms which are currently widely used, but, in specific cases, may include optional terms chosen by the applicant, the meanings of which should be interpreted in consideration of the meanings described or used in the present specification instead of by simply using the names of such terms. Hereinafter, embodiments of the present invention will be described in detail while referring to the accompanying drawings.

However, the present invention is not limited thereto and may be embodied in other forms. Throughout the description, the same reference numerals are used to refer to the same or similar elements.

A technical feature of the present invention is to provide a CMP pad conditioner which comprises a substrate and a plurality of cutting tips protruding from the surface of the substrate and spaced apart from each other, in which when the top surface of the cutting tips is formed parallel to the surface of the substrate, the average pressure which is applied to each of the cutting tips upon conditioning may be calculated, and an optimal average pressure range, for which the extent to which PWR changes as a result of one or more selected from among the kind of slurry, the material of a pad and changes in pressure is small, may be determined experimentally, thereby achieving an optimal structure which enables the stable use under any work conditions provided for conditioning, and also to provide a method of manufacturing the same.

Specifically, in the case where the CMP pad conditioner is configured such that pressure applied to each of the cutting tips thereof is set in the range of 0.001~0.2 lbf/cu$^2$/ea, even when one or more selected from among the kind of slurry, the material of a pad and changes in pressure are drastically changed, the extent of change in PWR may be remarkably decreased, as was experimentally proven.

Thus the CMP pad conditioner according to the present invention comprises a substrate; and a plurality of cutting tips which protrude upwards from the surface of the substrate and are spaced apart from each other, wherein a structure of the cutting tips is one in which the top surface of the cutting tips is a plane parallel to the surface of the substrate, and the average pressure applied to each of the cutting tips upon conditioning falls in the range of 0.001~0.2 lbf/cu$^2$/ea.

When the average pressure applied to each of the cutting tips of the CMP pad conditioner is determined in this way, the cutting tips should be formed so that the average pressure applied to each of the cutting tips is maintained almost constant even if they become worn down during conditioning. Hence, it is preferred that the upper portion of the cutting tips be formed so that an outer surface defined by connecting an outer circumference of the top surface of the cutting tips to an outer circumference of a cross-section of the cutting tips at a position 5~μm below the top surface of the cutting tips is at an angle of 87~93° with respect to the top surface of the cutting tips.

Experimentally, when the structure of the cutting tips is such that a difference between an area of the top surface of the cutting tips before use of the CMP pad conditioner and an area of the top surface of the cutting tips after a service life of the CMP pad conditioner is within 10% over the life of the CMP pad conditioner, preferable results may be obtained in terms of lengthening the life of the CMP pad conditioner and minimizing the extent of change in PWR.

The area of the top surface of each of the cutting tips included in the CMP pad conditioner according to the present invention is preferably 25~10000 μm$^2$, and the total height of the cutting tips may be 100 μm or less.

In the CMP pad conditioner having the structure of the present invention, PWR is uniformly maintained 2~10 times during conditioning compared to a conventional conditioner using diamond particles, regardless of the kind of slurry used, and pad roughness is also maintained at 2~10 μm during conditioning, thus exhibiting superior product properties.

In addition, the method of manufacturing the CMP pad conditioner according to the present invention comprises determining an average pressure applied to each of the cutting tips put in contact with the pad during conditioning to be in the range of 0.001~0.2 lbf/cu$^2$/ea; determining the size and the number of a plurality of cutting tips which are to be formed to protrude upwards from the surface of the substrate, depending on the average pressure which was determined; and forming the cutting tips on the substrate, depending on the size and the number of the cutting tips, which were determined.

Herein, the size and the number of the plurality of cutting tips which are to be formed to protrude upwards from the surface of the substrate are determined by Equation 1 below.

$$Pe=(D/As)\div T \qquad \text{[Equation 1]}$$

Pe: the average pressure applied to each of the cutting tips

D: a load (total pressure applied to the CMP pad conditioner)

As: sum of the areas of the top surface of all the cutting tips

T: the number of cutting tips

As such, the size of the cutting tips is determined by the area of the top surface of the cutting tips and the height thereof. The height does not affect the average pressure of the cutting tips and thus may be the known height of a conventional CMP pad conditioner. For example, the total height of the cutting tips may be 100 μm or less.

Also in the present invention, the size of the cutting tips may be set such that there are changes in the pad roughness and the debris size of the pad while PWR (μm/hr) is maintained constant. The area of the top surface of each of the cutting tips is preferably 25~10000 μm$^2$, which is determined experimentally. If the area of the top surface of the cutting tips is less than 25 μm$^2$, the load applied to each cutting tip may increase and thus the tips may be broken during usage undesirably scratching a wafer. In contrast, if the area thereof exceeds 10000 μm$^2$, the cutting tips may be larger than the pad pores and thus do not grind the pad and may clog the pad pores, making it impossible to perform conditioning efficiently.

Meanwhile in the present invention, variables for polishing a predetermined amount of the pad using the conditioner in which the height and the shape of the cutting tips are uniform may be represented by Equation 2 below.

$$Pw=PeT \quad \text{[Equation 2]}$$

Pw: the pad wear rate

Pe: the average pressure applied per tip

T: the number of cutting tips

When the area of the top surface of the cutting tips is 25~625 $\mu m^2$, the number of cutting tips necessary for representing PWR at a predetermined level calculated by Equation 2 in the average pressure range of 0.001~0.2 $lbf/cu^2/ea$ is 2680~190000. In the same manner, when the area of the cutting tips is 625~2500 $\mu m^2$, the number of cutting tips is 1340~38000, and when the area thereof is 2500~10000 $\mu m^2$, the number of tips is 670~19000, so that PWR at a predetermined level may be obtained.

Upon polishing the pad, the surface roughness and the debris size may vary depending on the area of the cutting tips, and thus the area of the cutting tips may be differently set so as to be adapted for requirements of the CMP process. Determining the area of the cutting tips allows the number of cutting tips to be determined.

When the size and the number of the cutting tips which are to be formed on the substrate are determined in this way, a substrate and protrusions having any one shape selected from among a cylindrical shape, a polyprism shape, a truncated cone shape and a truncated pyramid shape may be formed integratedly with or separately from each other using materials commonly used for a CMP conditioner, after which diamond is deposited on the surface of the substrate and the protrusions using CVD, thus forming a cutting part comprising a diamond layer.

EXAMPLE 1

The average pressure applied to each of the cutting tips put in contact with a pad during conditioning was determined to be 0.001, and the size and the number of cutting tips were determined using [Equation 1] Pe=(D/As)÷T under a load of 9 pounds, and thus a CMP pad conditioner 1 was manufactured as below.

Specifically, a disk-shaped substrate having a diameter of 4 inches was formed integratedly with 19000 protrusions having a truncated quadrangular pyramid shape the upper surface of which has a width and a length of 50 μm and a height of 70 μm.

Subsequently, diamond was deposited on the surface of the substrate and the protrusions using CVD thus forming a cutting part comprising a diamond layer. Particularly, the cutting part provided on the protrusions was formed so that in cutting tips comprising the protrusions and the cutting part the formation of which had been completed, an outer surface defined by connecting an outer circumference of the top surface of the cutting tips to an outer circumference of a cross-section of the cutting tips at a position 10 μm below the top surface of the cutting tips was at an angle of about 90° with respect to the top surface of the cutting tips, thus constituting the upper portion of the cutting tips.

EXAMPLE 2

A CMP pad conditioner 2 was manufactured in the same manner under the same conditions as in Example 1, with the exception that the average pressure applied to each of the cutting tips put in contact with a pad during conditioning was determined to be 0.03, and the upper portion of the cutting tips, specifically, an outer surface defined by connecting an outer circumference of the top surface of the cutting tips to an outer circumference of a cross-section of the cutting tips at a position 10 μm below the top surface of the cutting tips was at an angle of about 89° with respect to the top surface of the cutting tips.

The width and the length of the upper surface of the cutting tips of the CMP pad conditioner 2 thus manufactured were both 50 μm, and the total number of cutting tips was 3450.

EXAMPLE 3

A CMP pad conditioner 3 was manufactured in the same manner under the same conditions as in Example 1, with the exception that the average pressure applied to each of the cutting tips put in contact with a pad during conditioning was determined to be 0.05, and the upper portion of the cutting tips, specifically, an outer surface defined by connecting an outer circumference of the top surface of the cutting tips to an outer circumference of a cross-section of the cutting tips at a position 10 μm below the top surface of the cutting tips was at an angle of about 91° with respect to the top surface of the cutting tips.

The width and the length of the upper surface of the cutting tips of the CMP pad conditioner 3 thus manufactured were both 50 μm, and the total number of cutting tips was 2700.

EXAMPLE 4

A CMP pad conditioner 4 was manufactured in the same manner under the same conditions as in Example 1, with the exception that the average pressure applied to each of the cutting tips put in contact with a pad during conditioning was determined to be 0.07.

The width and the length of the upper surface of the cutting tips of the CMP pad conditioner 4 thus manufactured were both 50 μm, and the total number of cutting tips was 2275.

EXAMPLE 5

A CMP pad conditioner 5 was manufactured in the same manner under the same conditions as in Example 1, with the exception that the average pressure applied to each of the cutting tips put in contact with a pad during conditioning was determined to be 0.09, and the upper portion of the cutting tips, specifically, an outer surface defined by connecting an outer circumference of the top surface of the cutting tips to an outer circumference of a cross-section of the cutting tips at a position 10 μm below the top surface of the cutting tips was at an angle of about 89° with respect to the top surface of the cutting tips.

The width and the length of the upper surface of the cutting tips of the CMP pad conditioner 5 thus manufactured were both 50 μm, and the total number of cutting tips was 2000.

EXAMPLE 6

A CMP pad conditioner 6 was manufactured in the same manner under the same conditions as in Example 1, with the exception that the average pressure applied to each of the cutting tips put in contact with a pad during conditioning was determined to be 0.11, and the upper portion of the cutting tips, specifically, an outer surface defined by connecting an outer circumference of the top surface of the cutting tips to an outer circumference of a cross-section of the cutting tips at a position 10 μm below the top surface of the cutting tips was at an angle of about 91° with respect to the top surface of the cutting tips.

The width and the length of the upper surface of the cutting tips of the CMP pad conditioner 6 thus manufactured were both 50 μm, and the total number of cutting tips was 1800.

EXAMPLE 7

A CMP pad conditioner 7 was manufactured in the same manner under the same conditions as in Example 1, with the exception that the average pressure applied to each of the cutting tips put in contact with a pad during conditioning was determined to be 0.13.

The width and the length of the upper surface of the cutting tips of the CMP pad conditioner 7 thus manufactured were both 50 μm, and the total number of cutting tips was 1670.

EXAMPLE 8

A CMP pad conditioner 8 was manufactured in the same manner under the same conditions as in Example 1, with the exception that the average pressure applied to each of the cutting tips put in contact with a pad during conditioning was determined to be 0.15, and the upper portion of the cutting tips, specifically, an outer surface defined by connecting an outer circumference of the top surface of the cutting tips to an outer circumference of a cross-section of the cutting tips at a position 10 μm below the top surface of the cutting tips was at an angle of about 89° with respect to the top surface of the cutting tips.

The width and the length of the upper surface of the cutting tips of the CMP pad conditioner 8 thus manufactured were both 50 μm, and the total number of cutting tips was 1550.

EXAMPLE 9

A CMP pad conditioner 9 was manufactured in the same manner under the same conditions as in Example 1, with the exception that the average pressure applied to each of the cutting tips put in contact with a pad during conditioning was determined to be 0.165, and the upper portion of the cutting tips, specifically, an outer surface defined by connecting an outer circumference of the top surface of the cutting tips to an outer circumference of a cross-section of the cutting tips at a position 10 μm below the top surface of the cutting tips was at an angle of about 91° with respect to the top surface of the cutting tips.

The width and the length of the upper surface of the cutting tips of the CMP pad conditioner 9 thus manufactured were both 50 μm, and the total number of cutting tips was 1475.

EXAMPLE 10

A CMP pad conditioner 10 was manufactured in the same manner under the same conditions as in Example 1, with the exception that the average pressure applied to each of the cutting tips put in contact with a pad during conditioning was determined to be 0.18.

The width and the length of the upper surface of the cutting tips of the CMP pad conditioner 10 thus manufactured were both 50 μm, and the total number of cutting tips was 1415.

EXAMPLE 11

A CMP pad conditioner 11 was manufactured in the same manner under the same conditions as in Example 1, with the exception that the average pressure applied to each of the cutting tips put in contact with a pad during conditioning was determined to be 0.2, and the upper portion of the cutting tips, specifically, an outer surface defined by connecting an outer circumference of the top surface of the cutting tips to an outer circumference of a cross-section of the cutting tips at a position 10 μm below the top surface of the cutting tips was at an angle of about 89° with respect to the top surface of the cutting tips.

The width and the length of the upper surface of the cutting tips of the CMP pad conditioner 11 thus manufactured were both 50 μm, and the total number of cutting tips was 1340.

COMPARATIVE EXAMPLE 1

A comparative CMP pad conditioner 1 was manufactured in the same manner under the same conditions as in Example 1, with the exception that the average pressure applied to each of the cutting tips put in contact with a pad during conditioning was determined to be 0.0005.

The width and the length of the upper surface of the cutting tips of the comparative CMP pad conditioner 1 thus manufactured were both 50 μm, and the total number of cutting tips was 26800.

COMPARATIVE EXAMPLE 2

A comparative CMP pad conditioner 2 was manufactured in the same manner under the same conditions as in Example 1, with the exception that the average pressure applied to each of the cutting tips put in contact with a pad during conditioning was determined to be 0.22.

Both the width and the length of the upper surface of the cutting tips of the comparative CMP pad conditioner 2 thus manufactured were 50 μm, and the total number of cutting tips was 1280.

TEST EXAMPLE 1

A test was carried out to measure PWR of the CMP pad conditioners 1 to 11 of Examples 1 to 11 and the comparative CMP pad conditioners 1 and 2 depending on the slurry. Specifically, during the conditioning process under a load of 9 pounds using a tungsten slurry, the extent of change in PWR under the average pressure applied to each of the cutting tips of the CMP pad conditioner was observed. The results are shown in FIG. 1.

TEST EXAMPLE 2

The same test as in Test Example 1 was performed, with the exception that an oxide slurry was used. The results are shown in FIG. 2.

TEST EXAMPLE 3

The same test as in Test Example 1 was performed, with the exception that a copper slurry was used. The results are shown in FIG. 3.

Figure 2:
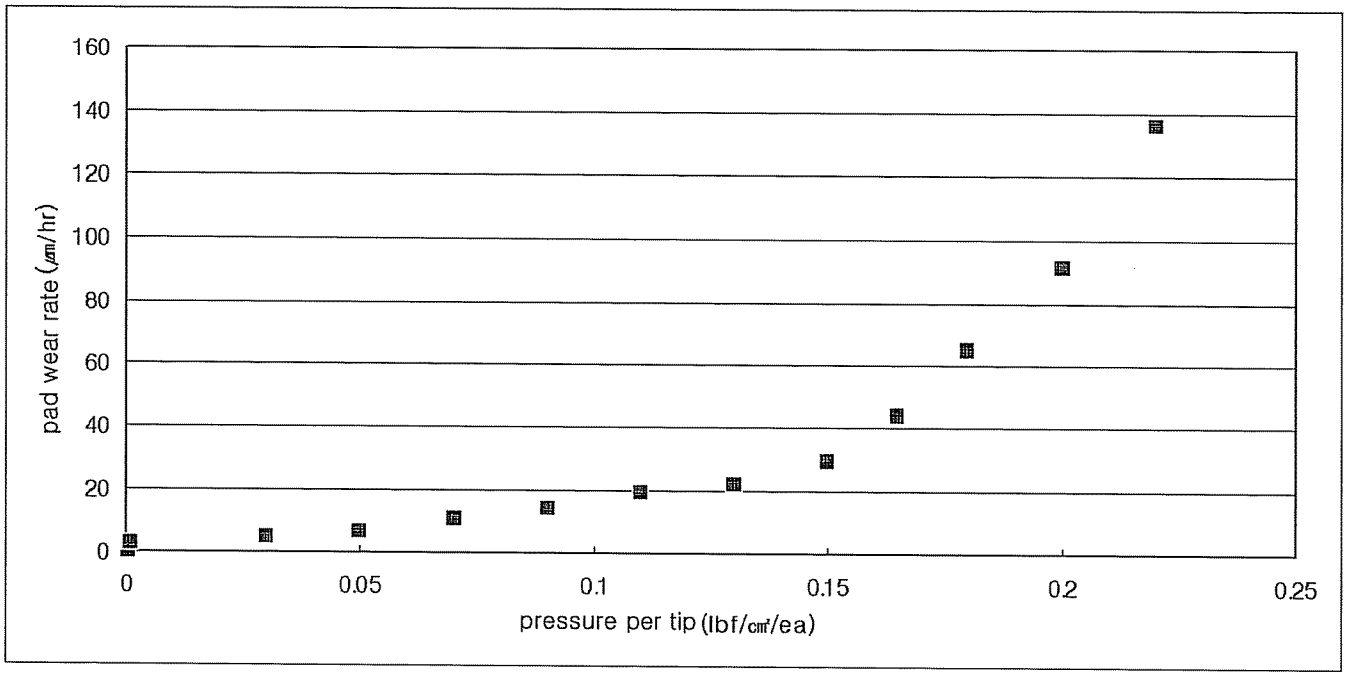
Figure 3:
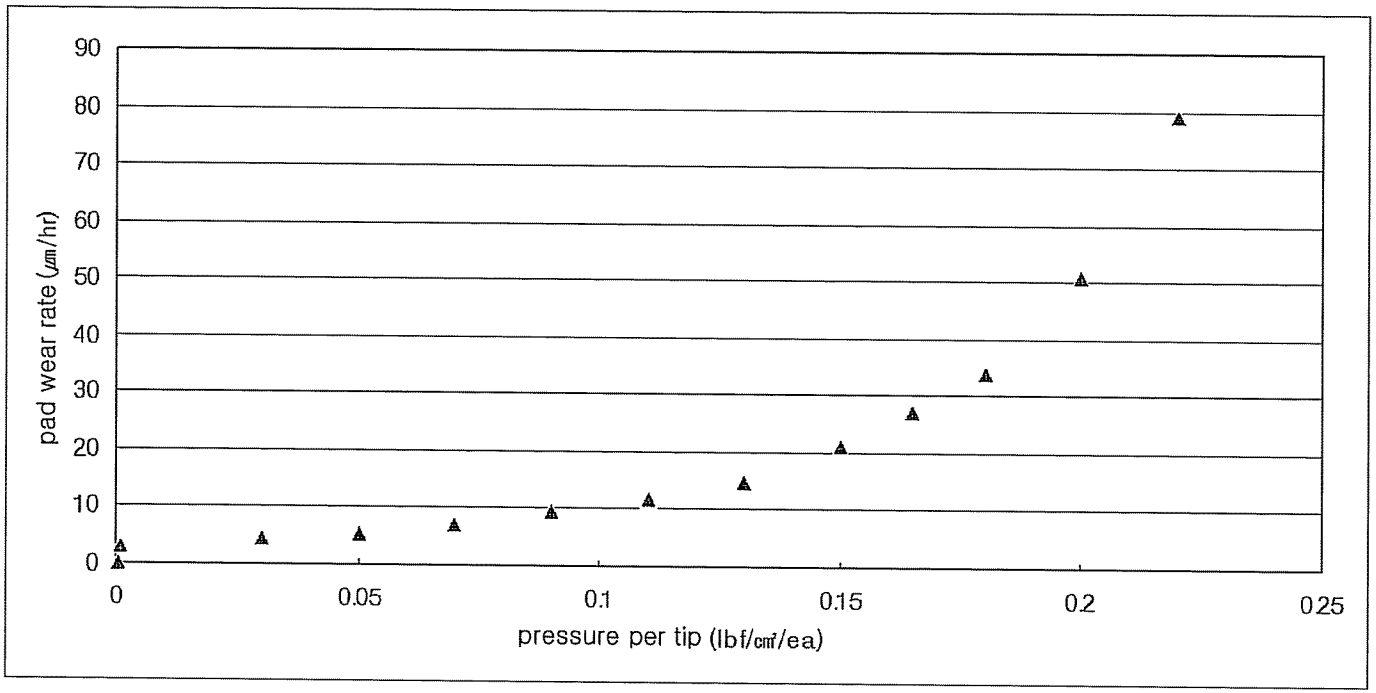

As is apparent from FIGS. 1 to 3 showing the results of Test Examples 1 to 3, even when different slurries are used, PWR is set equal to or lower than 100 under a condition of the average pressure applied to each of the cutting tips of the CMP pad conditioner falling in the range of 0.001~0.2 lbf/$cu^2$/ea, so that the conditioning process can be seen to be effectively performed. Particularly if the average pressure is less than 0.001 lbf/$cu^2$/ea, the PWR approximates zero. In contrast, if the average pressure exceeds 0.2 lbf/cu$^2$/ea, the PWR may become greater than 100 μm/hr, making it impossible to apply such a pad conditioner to the conditioning process.

Hence, in order to minimize the extent of change in PWR depending on the kind of slurry, the average pressure applied to each of the cutting tips of the CMP pad conditioner according to the present invention has to fall in the range from 0.001 lbf/cu$^2$/ea to 0.2 lbf/cu$^2$/ea.

TEST EXAMPLE 4

In order to evaluate changes in PWR and the pad roughness depending on conditioning time, the conditioning process was carried out for 50 hr under the same conditions as in Test Example 1 using the CMP pad conditioner 4 of Example 4. The results are shown in Table 1 below and FIG. 4.

Figure 4:
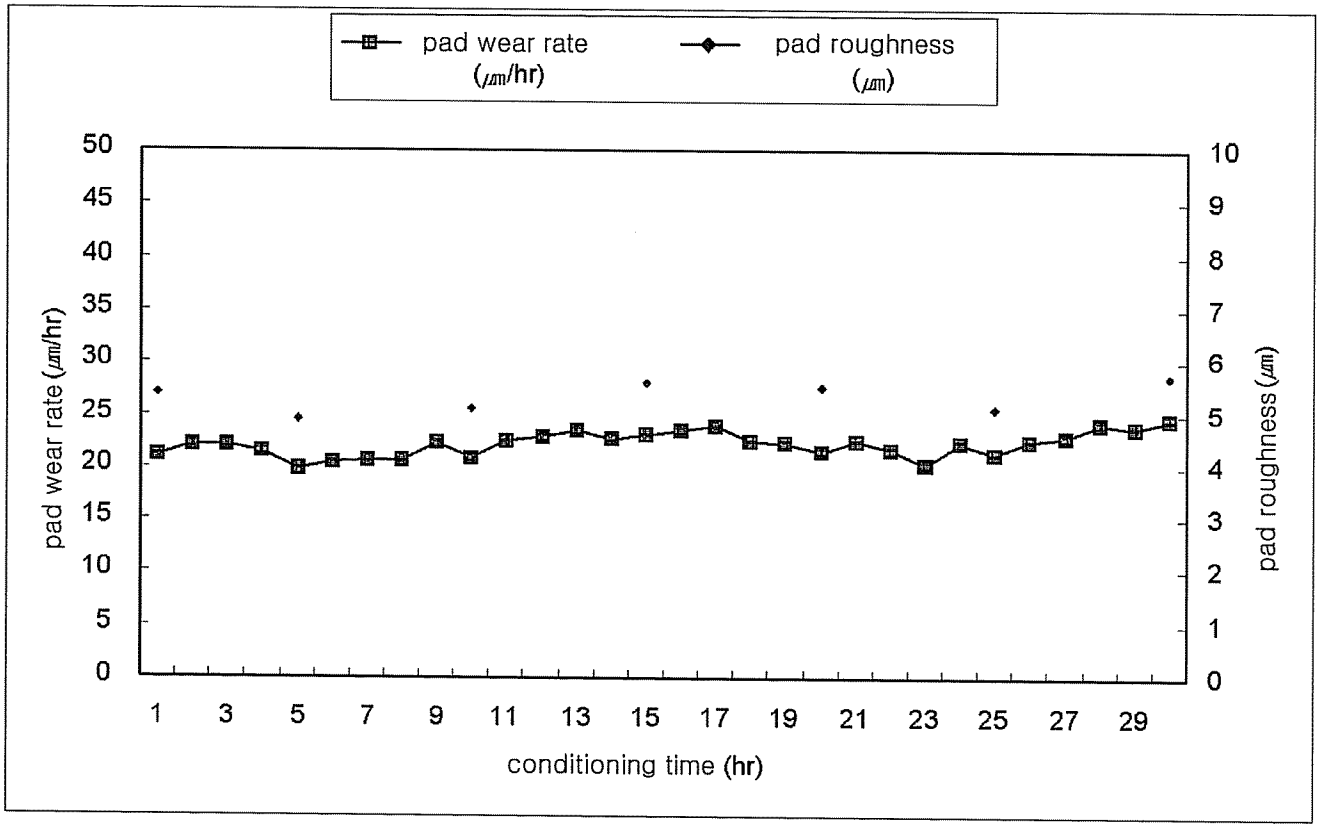
FIG. 4 is a graph showing the results of measuring PWR and the pad roughness of the CMP pad conditioner 4 of Example 4 according to the present invention, depending on the conditioning time.

As is apparent from Table 1 and FIG. 4 showing the results of Test Example 4, PWR and the pad roughness when using the CMP pad conditioner of the present invention for at least a predetermined period of time can be seen to be maintained to the level that is almost the same as the initial values.

TABLE 1

| Time (hr) | PWR (μm/hr) | Pad Roughness (μm) |
|---|---|---|
| 1 | 21.0 | 5.4 |
| 2 | 22.0 | |
| 3 | 22.0 | |
| 4 | 21.3 | |
| 5 | 19.8 | 4.9 |
| 6 | 20.3 | |
| 7 | 20.5 | |
| 8 | 20.5 | |
| 9 | 22.2 | |
| 10 | 20.7 | 5.1 |
| 11 | 22.5 | |
| 12 | 22.9 | |
| 13 | 23.5 | |
| 14 | 22.6 | |
| 15 | 23 | 5.6 |
| 16 | 23.4 | |
| 17 | 23.9 | |
| 18 | 22.4 | |
| 19 | 22.3 | |
| 20 | 21.5 | 5.5 |
| 21 | 22.5 | |
| 22 | 21.7 | |
| 23 | 20.2 | |
| 24 | 22.3 | |
| 25 | 21.2 | 5.1 |
| 26 | 22.4 | |
| 27 | 22.9 | |
| 28 | 24 | |
| 29 | 23.6 | |
| 50 | 24.4 | 5.7 |

Although in FIG. 4 the longest time recorded was only 30 hr, as shown in Table 1, even when the tungsten slurry which wears down diamonds quickly was used, PWR was seen to be maintained constant even after 50 hr.

Furthermore, although Table 1 and FIG. 4 only present the results of using the CMP pad conditioner 4, the CMP pad conditioners 1 to 3 and 5 to 11 can be seen to keep almost the same values as in the CMP pad conditioner 4.

As mentioned above, the CMP pad conditioners of the present invention can provide an optimal structure which enables stable use under any work conditions pertaining to conditioning because the extent of change in PWR depending on the kind of slurry and the changes in pressure is very small, as was proven.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A CMP (Chemical Mechanical Polishing) pad conditioner, comprising:

a substrate; and a plurality of cutting tips protruding upwards from a surface of the substrate and spaced apart from each other, wherein the cutting tips have a structure in which a top surface of each of the cutting tips is a plane parallel to the surface of the substrate, and wherein the plurality of cutting tips comprises a number of cutting tips such that, under a load applied to the CMP pad conditioner for conditioning, an average pressure applied to each of the cutting tips ranges from $1.55\times10^{-4}$ lbf/in$^2$ to $3.1\times10^{-2}$ lbf/in$^2$.

2. The CMP pad conditioner of claim 1, wherein an upper portion of the cutting tips is formed so that an outer surface defined by connecting an outer circumference of the top surface of the cutting tips to an outer circumference of a cross-section of the cutting tips at a position 5~50 μm below the top surface of the cutting tips is at an angle of 87~93° with respect to the top surfaces of the cutting tips.

3. The CMP pad conditioner of claim 1, wherein the cutting tips comprise protrusions and a cutting part extending from each of the protrusions and formed integrally with or separately from the protrusions, wherein when the protrusions and the cutting part are formed separately from each other, the cutting part formed on upper surfaces of the protrusions comprises a diamond layer formed by depositing diamond onto the upper surfaces of the protrusions using chemical vapor deposition.

4. The CMP pad conditioner of claim 1, wherein a difference between an area of top surfaces of the cutting tips before use of the CMP pad conditioner and an area of the top surfaces of the cutting tips after a service life of the CMP pad conditioner is within 10% over the life of the CMP pad conditioner.

5. The CMP pad conditioner of claim 4, wherein the area of the top surfaces of the cutting tips is 25~10000 μm$^2$.

6. The CMP pad conditioner of claim 1, wherein a pad roughness is maintained in a range of 2~10 μm during conditioning.

7. The CMP pad conditioner of claim 1, wherein at least one of the size of and the number of cutting tips is determined according to the following Equation 1:

$$Pe=(D/As)\div T, \quad \text{[Equation 1]}$$

Pe: an average pressure applied to each of the cutting tips,

D: a load applied to the CMP pad conditioner,

As: a sum of areas of top surfaces of each the cutting tips, and

T: a number of cutting tips.

8. A method of manufacturing a CMP pad conditioner comprising:

determining an average pressure to be applied to each cutting tip of a substrate put in contact with a pad during conditioning, the average pressure being in a range from $1.55\times10^{-4}$ lbf/in$^2$ to $3.1\times10^{-2}$ lbf/in$^2$;

determining a size and a number of a plurality of cutting tips to be formed to protrude upwards from a surface of the substrate depending on the determined average pressure; and forming the cutting tips on the substrate depending on the determined size and the determined number of the cutting tips.

9. The method of claim 8, wherein at least one of the size of and the number of the plurality of cutting tips is determined by the following Equation 1:

$$Pe=(D/As)\div T, \quad \text{[Equation 1]}$$

Pe: an average pressure applied to each of the cutting tips,

D: a load applied to the CMP pad conditioner,

As: a sum of areas of top surfaces of each the cutting tips, and

T: a number of cutting tips.

10. The method of claim 8, wherein the forming the cutting tips on the substrate comprises:

integrally or separately forming the substrate and protrusions, the protrusions having any one shape selected from among a cylindrical shape, a polyprism shape, a truncated cone shape, and a truncated pyramid shape; and depositing diamond on a surface of at least one of the substrate and the protrusions using chemical vapor deposition thus forming a cutting part comprising a diamond layer.

11. The method of claim 8, wherein in the forming the cutting tips on the substrate comprises:

forming an upper portion of the cutting tips so that an outer surface defined by connecting an outer circumference of a top surface of the cutting tips to an outer circumference of a cross-section of the cutting tips at a position 5~50 μm below the top surface of the cutting tips is at an angle of 87~93° with respect to the top surface of the cutting tips.

12. The method of claim 8, wherein an area of the top surfaces of the cutting tips is 25~10000 $\mu m^2$.

13. The method of claim 12, wherein the cutting tips are formed in a columnar shape including a cylindrical shape or a polyprism shape, and a surface of the cutting tips comprises a diamond thin-film coating layer.

14. The method of claim 12, wherein when the area of the top surfaces of the cutting tips is 25~625 $\mu m^2$, 2680~190000 cutting tips are formed, and when the area thereof is 625~2500 $\mu m^2$, 1340~38000 cutting tips are formed, and when the area thereof is 2500~10000 $\mu m^2$, 670~19000 cutting tips are formed.

15. The method of claim 12, wherein a pressure range which is applied to the cutting tips is adjusted depending on the area of the top surfaces of the cutting tips, so that the pressure applied to each of the cutting tips is controlled without changing a pad wear rate.

* * * * *